United States Patent [19]

Aoki et al.

[11] 4,416,043

[45] Nov. 22, 1983

[54] DISC ROLL

[75] Inventors: Susumu Aoki, Yokohama; Hiroshi Asaumi, Kamakura; Shigeo Take, Ayase; Masazumi Akase, Yokohama, all of Japan

[73] Assignee: Nippon Asbestos Company, Limited, Tokyo, Japan

[21] Appl. No.: 262,029

[22] Filed: May 8, 1981

[30] Foreign Application Priority Data

May 12, 1980 [JP] Japan ..... 55-61749

[51] Int. Cl.[3] ..... B21B 27/00

[52] U.S. Cl. ..... 29/132

[58] Field of Search ..... 501/95, 123; 29/132

[56] References Cited

U.S. PATENT DOCUMENTS 3,852,862 12/1974 Sukenik ..... 29/132

FOREIGN PATENT DOCUMENTS 1278473 6/1972 United Kingdom ..... 501/95

*Primary Examiner*—Eugene F. Desmond

*Attorney, Agent, or Firm*—Wenderoth, Lind & Ponack

[57] ABSTRACT

This invention relates to a disk roll characterized in that the flaky vermiculite particles obtained by pulverizing the expanded vermiculite, which may be optionally mixed with a fiber material, are dispersed in water and filtered to form a thin sheet as a starting material for disk roll.

6 Claims, No Drawings

DISC ROLL

DETAILED DESCRIPTION OF THE INVENTION

The present invention relates to a disk roll. In the processes for preparing glass panes and for heat-treating sheets or pipes of stainless steel, copper and brass, a so-called asbestos roll is generally used as the roll for conveying the semi-products or the treated products of said metals. The asbestos rolls can be prepared in such a manner that an asbestos plate of ca. 6 mm in thickness, after being punched out in the form of a disk be piled up to a predetermined thickness and a metal rod of steel etc. can be inserted through the disc to serve as the rotation axis. The disc is then compressed in the direction of the rotation axis to form a compact structure, and the surfaces of the asbestos roll may be cut away by lathe etc. to produce a fine finish. The resulted product is generally called "disk roll," since the disk roll for the above fields of application is subjected to harsh temperature conditions such as the continuous exposal to a temperature ranging from several hundreds to a thousand degrees; therefore the disc material should be highly refractory (fire resistant). However, the refractoriness of an asbestos plate as a disk material for the asbestos roll, for example, has been generally rather insufficient for the above fields of application. This is because of the undesirable thermal characteristics of the asbestos fiber as the main component of the asbestos plate. That is, asbestos fibers lose their water of crystallization, thereby contracting when heated to a temperature higher than 400°–800° C. while the center steel axis of the roll is expanded, thus producing an asbestos roll containing axial cracks and annular cracks rectangular thereto. Once such cracks are generated, the hot gas contained in the furnace permeates into the cracks which cracks then grow larger, thus creating finally the asbestos plate to separate off. Also gaps occur between the asbestos and iron core rod and so the asbestos plate partially rises and partially tends to become rugged. Such cracks, ruggedness and separation from the iron core not only deteriorates the quality of the glass pane products treated therewith, and also exerts uneven pressure on the surface of glass pane to cause damage of the glass products because of the cracks and ruggedness of the disks which are transferred to the surface of softened material to be treated, thus remarkably deteriorating the quality of the surface.

In the case of treating stainless steel sheets, for example, the heat-treatment proces of metal sheets requires that they be heat-treated at a temperature from 1000°–1200° C., but there cannot be found any roll material usable in the furnace at such a high temperature. This is why it has been necessary to use plural furnaces of smaller length (12–15 m) of a catenary type, wherein the asbestos rolls for supporting the material to be treated are arranged in lower temperature zones at the entrances and the exits of the furnace. In this case, because the material to be treated is exposed to the atmosphere between the furnaces, there have been many problems involving quality control in that oxide scale etc. of the material to be treated is peeled, the surfaces of the material to be treated are scratched, and the scale possess difficulties in that descaling effects are produced. Furthermore, the employment of plural smaller furnaces not only makes the atmosphere within the furnaces difficult to control but also makes unavoidable the reduction of thermal efficiency due to the lowering of the treating temperature between furnaces and the increased chances of the intrusion of the atmosphere into the furnaces. These difficulties are undesirable from the viewpoint of conserving energy.

Further, when the disk is made of asbestos, asbestos dust is formed, which is harmful to human beings. Thus, the asbestos roll should be carefully handled when being cut for finish with the lathe and when being employed for rolling work.

The present invention was achieved by research designed to produce a disk roll having the highest refractory and wear-resistance characteristics and to produce disks which are more excellent than the conventional asbestos rolls which do not scratch the surface of the material to be treated.

A disk roll as set forth according to the present invention is prepared by the process wherein flaky vermiculite particles obtained by pulverizing expanded vermiculite, which may be optionally mixed with a fiber material, dispersing the material in water and filtering the thus-produced vermiculite material to form a thin sheet as the starting material.

The disk material for the disk roll of the present invention comprises a refractory sheet which has excellent characteristics for use as a disk material, which has not previously been used for this purpose.

Hereinafter, the refractory sheet of the present invention, prepared from vermiculite, will be described more particularly.

Vermiculite is a silicate hydrite having a crystalline structure similar to that of smectite, chlorite, mica etc. and contains between its crystalline layers a large quantity of water molecules, which water when heated is rapidly scattered to spread like an accordion. Also when these minerals are subjected to the treatment with peroxide, such as hydrogen peroxide, a reaction occurs between the crystaline layers to generate gas and forcibly widen the space between the layers. Then the minerals expand like an accordion similar to that of thermal expansion.

The thus expanded vermiculite is light in density, is refractory, and possesses heat-insulating and sound-absorbing properties; this may be used as construction materials, refractory materials etc. In the case of being used as the sheet-forming raw material of the present invention, the vermiculite is pulverized to form flaky particles.

The pulverization process should be carried out until the vermiculate has a granular diameter of less than 1 mm and a thickness of less than 100 μm. In the case of vermiculite being treated with expansion according to the normal process, the crystal layers between, which there are formed flat spaces, are combined with smaller coupling power and therefore flaky thin pieces are easily obtained.

The new-generated flat surfaces of thin flakes of said pulverized vermiculite have very high activity when contacted with water. Therefore, the expanded vermiculite flat particles, after having been pulverized in a dry process in an aqueous process, are dehydrated by filtration etc., and dried, are recombined with strong attractive force.

The mutual coupling effect of the expanded surfaces of the flakes grows higher, as the new-generated surfaces of the flakes develop larger contact proportion, as the thickness of the thin flakes turns smaller for a definite weight of flakes, and as the flakes become more oriented in the same direction. Therefore, when the vermiculite flakes obtained by pulverizing the expanded vermiculite are emulsified and then filtered, they form a stable sheet, of which the wet strength, the coupling strength between layers, the workability and the mechanical properties of the vermiculite product are similar to or higher than those of ordinary asbestos plates. As will be described later, they have most desirable chracteristics as a disk material for a disk roll.

The sheet prepared from the vermiculite flakes as a raw material can be improved in characteristics as a disk material when the sheet is mixed with a fiber material such as wollastonite fibers and ceramic fibers.

Wollastonite fiber or an inorganic fiber chiefly produced from Wisboro, N.Y., U.S.A. is composed of a calcium silicate crystal ($CaSiO_3$). Its chemical analytic values and characteristics are as follow:

$SiO_2$ 50.90%, CaO 46.90%, $Fe_2O_3$ 0.55%, $Al_2O_3$ 0.25%, MgO 0.10%, MnO 0.10%, $TiO_2$ 0.05% and ignition loss 0.90%, Total 99.75% Crystal structure: needle-like Melt. point: 1540° C. Spec. gravity: 2.9 Color: gleamy white Because the wallastonite fiber is composed of stable crystals of $CaSiO_3$ not containing the water of crystallization, nor ferrous oxide (FeO) in its crystal structure, it does not shrink nor lose in fibrous strength without structural change due to dehydration, oxidation or crystallization, such as found in asbestos fibers. However, because of the wollastonite fiber is short, e.g., about 2–3 mm or less in length and is not flexible, its collective mass behaves itself like powder. When wollastonite fibers are mixed with vermiculite flakes in a sheet-forming process, however short the vermiculite fibers may be, they entangle themselves with the vermiculite particles to present an adhesiveness at least as excellent as that between the layers in conventional asbestos plates. Furthermore, this sheet has better workability and refractoriness than a sheet prepared exclusively from vermiculite particles. Such improvement in the characteristics of the sheet on account of mixing with wollastonite fibers is enhanced by mixing with at least about 40% of wallastonite fibers. However, when an amount at least about 230% is mixed, the adhesiveness between the vermiculite layers is weakened due to the shortage of vermiculite particles to obstruct the sheet-forming process, resulting in a loss of flexibility in the sheet product.

The case of employing ceramic fibers in admixture with the vermiculite will now be described.

Similarly to the case of mixing with wollastonite fibers, when ceramic fibers, such as crystalline alumina fibers (hereafter referred to as C.A.F.) or silica fibers (referred to as S.F.) are mixed to execute the sheet-forming process, the refractory properties of the sheet is improved further than in case of using vermiculite exclusively.

The effective mixing proportion of C.A.F. or S.F. to the vermiculite particles resides in a range from 10–100%. In the case where the mixing ratio exceeding 100%, the wear resistance will be reduced even though the refractoriness may be improved.

Though a great quantity of granules or so-called "shots" are often included in the ceramic fibers, the shots adversely influence the function of the disk, and so it is desirable to use a material with a smaller content of shots. When the vermiculite particles or the mixture of fiber material therewith are subjected to the sheet-forming process to prepare the sheet, other supplementary materials for the improvement of the sheet-forming workability, for example, hydrophilic organic fibers such as wooden pulp and rayon fibers; binders such as starch, polyvinyl alcohol, carboxymethyl cellulose; and fillers such as alumina, silica, talc, bentonite, mica, clay, may be added, but the mixing quantity of these materials should preferably be less than 50% of the total sheet-forming raw material. Also asbestos in a quantity of less than 50% of the vermiculite particles may be added without involving the drawbacks due to the properties peculiar to asbestos alone as mentioned above.

The sheet forming filtration process may be executed by dispersing the above-mentioned raw material homogeneously in a suitable quantity of water and employing a Fourdrinier paper machine or cylinder mold paper machine. The thickness of the sheet should be made within a range from 0.5–8 mm after drying.

The raw material for the disk as prepared by the above-mentioned process can be worked to prepare a disk roll similarly to the process for preparing an asbestos roll from an asbestos plate. The fastening pressure for the disk, after being fitted to the rotation axis, is different depending on the application of the disk roll, but should be generally within a range from 50–250 $kg/cm^2$. It is preferable that the bulk density of the disk part of the roll should be from 1.2–1.8 $g/cm^3$. As the grinding workability of the disk part is very high, an accurate polishing finish may be possible.

A disk roll prepared by the process of the present invention is highly refractory and wear resistant, and particularly a disk roll prepared from the disk material of vermiculite particles as the principal component will ensure the product of a disk roll having a soft and wear-resistant surface which is suitable for a glass pane-making machine, whereas a disk roll prepared from the disk material added with wollastonite fibers or ceramic fibers has such a high refractoriness that the exposal to a high temperature from 1000°–1250° C. for a long time may not cause cracks and the disk rolls may be properly used in the heat-treatment of steel.

Because a disk roll according to the present invention is not only profitable to prevent such environmental hygienic problems as that of the conventional asbestos rolls, it also has the excellent functional capability as mentioned above because it is possible to operate the apparatus for heat-treating stainless steel plates with the disk roll of the present invention for a long time without damaging the surface of the work material to be treated. Even in the case of the high temperature treatment at a temperature higher than 1000° C., it is unnecessary to employ conventional parallel-arranged furnaces of lower thermal efficiency due to the convention rolls having limited temperature resistance, which furnace design poses difficulties in controlling the atmosphere within the furnaces; thus more reasonable furnaces can be designed.

The present invention will now be described with reference to the following Examples.

EXAMPLE 1

A mixture consisting of 93% of baked and expanded vermiculite No. 3 which was then pulverized in dry form into dry flaky particles (less than 1 mm in diameter and less than 100$\mu$ in thickness), in conjunction with 4% of pulp and 3% of starch, is subjected to a sheet-forming process and dried to form a sheet of 6 mm in thickness. Then the sheet is punched into rings of 325 mm in outer diameter and 242 mm in inner diameter, which rings are then successively fitted onto the iron axis of rotation and are fastened till compressed under a pressure of 150 kg/cm$^2$. The peripheral surface is trimmed with a lathe to finish into a disk roll of 1.6 g/cm$^3$ in bulk density. The resulted disk roll, after having been used one month as a roll for lifting a glass melt at 800° C. in a pane-making furnace, shows no cracks. The observed amount of abrasion is about one fifth of that of a conventional asbestos roll.

EXAMPLE 2

A mixture consisting of 33% of the vermiculite particles employed in Example 1, in conjunction with 4% of pulp, 60% of wollastonite fibers, and 3% of starch is subjected to a sheet-forming process and dried to form a sheet of 6 mm in thickness. Then the sheet is punched into rings of 225 mm in outer diameter and 115 mm in inner diameter, which rings are then fitted onto the iron axis of rotation similarly to Example 1 to obtain a disk roll of 250 mm in diameter and 1676 mm in length, the bulk density of the disk roll being 1.7 g/cm$^3$. The resulted disk roll, after having been used five months at 1200° C. in a heat-treatment furnace for producing stainless steel plates, shows no cracks. Also this roll is especially excellent in the wear resistance, and the observed amount of abrasion is about one seventh of that of conventional asbestos rolls.

EXAMPLE 3

A mixture consisting of 63% of the vermiculite particles employed in Example 1, in conjunction with 4% of pulp, 30% of crystalline alumina fibers and 3% of starch is subjected to a sheet-forming process and dried to form a sheet of 6 mm in thickness. A disk roll of the same dimensions as those of Example 2 and having a bulk density of 1.5 g/cm$^3$ is obtained from said sheet. The resulted disk roll, after having been used five months at 1200° C. in a heat-treatment furnace for producing a finished product of a stainless steel plate, shows no cracks. Also this roll is excellent in wear resistance, and the observed amount of abrasion is about one fifth of that of a conventional asbestos roll. On the other hand, the surface of the treated steel plate is so beautiful at the terminal period of the disk roll that substantially no scratches caused by the disk roll are found.

EXAMPLE 4

Different asbestos sheets of 6 mm in thickness are obtained with an ordinary cylinder mold paper machine from the material composition as shown in Table 1. The employed vermiculite particles are prepared by pulverizing in dry form the expanded vermiculite No. 3 in a Miracle mill. The particles have a diameter less than 1 mm and a thickness less than 100$\mu$. The characteristics are shown in Table II. "The coefficient of volume variation with heating" denotes the volume difference of the after volume from the volume of a sample of 50×50 mm prior to heating for 24 hours at a predetermined temperature in an electric furnace followed by cooling.

After, these sheets are stamped with an annular punch of 130 mm in outer diameter and 60 mm in inner diameter. The obtained disks are piled together to form a disk roll of 150 mm in length under a fastening pressure 150 kg/cm$^3$ and are heated for 100 hours in a furnace. After cooling and treatment, any occurrence of cracks in the surface of the roll surface, after a load of 8 kg/cm has been applied with a stainless steel plate on the roll surface while rotating at a speed of 10 R.P.M. was observed. In the case of the occurrence of cracks, the wear resistance was not tested.

TABLE 1

| | Test No. | Raw material for the paper-making process (%) | | | | | |
|---|---|---|---|---|---|---|---|
| | | Vermiculite particles | Wollastonite fibers | Crystalline alumina fibers | Asbestos crysotile | Pulp | Starch |
| Examples of the present invention | 1 | 93 | | | | 4 | 3 |
| | 2 | 33 | 60 | | | 4 | 3 |
| | 3 | 54 | 40 | | | 4 | 3 |
| | 4 | 63 | | 30 | | 4 | 3 |
| | 5 | 53 | | 40 | | 4 | 3 |
| | 6 | 43 | 30 | 20 | | 4 | 3 |
| | 7 | 75 | 18 | | | 4 | 3 |
| | 8 | 85 | | 8 | | 4 | 3 |
| Comparative Ex. | | | | | 97 | | 3 |

TABLE 2

| | Test No. | Bulk density (g/cm$^3$) | Coefficient of volume variation with heating (%) | | | |
|---|---|---|---|---|---|---|
| | | | 800° C. | 1000° C. | 1200° C. | 1300° C. |
| Examples of the present invention | 1 | 1.00 | −3.7 | 0 | 3.8 | 7.0 |
| | 2 | 1.10 | −2.1 | −1.9 | −1.8 | 0 |
| | 3 | 1.05 | −2.6 | −1.7 | −1.4 | 0 |
| | 4 | 0.85 | −3.0 | −1.8 | 0 | 1.0 |
| | 5 | 0.80 | −2.8 | −1.6 | 0 | 1.6 |
| | 6 | 0.90 | −2.9 | −1.9 | −1.2 | 0.8 |
| | 7 | 1.05 | −2.1 | 0 | 1.8 | 3.9 |
| | 8 | 0.95 | −2.3 | 0 | 1.9 | 4.1 |
| Comparative Ex. | | 1.00 | 4.4 | 7.3 | 25.7 | * |

*Crack is too large to measure.

TABLE 3

| | Test No. | Bulk density of disk part (g/cm$^3$) | Test item | Heating temperature (°C.) | | | | |
|---|---|---|---|---|---|---|---|---|
| | | | | 900 | 1000 | 1100 | 1200 | 1250 |
| Examples of the present invention | 1 | 1.60 | Crack | ◎ | ◎ | ○ | Δ | x |
| | | | Wear resistance | ◎ | ◎ | — | — | — |
| | 2 | 1.70 | Crack | ◎ | ◎ | ◎ | ◎ | ◎ |
| | | | Wear resistance | ◎ | ◎ | ◎ | ◎ | ◎ |
| | 3 | 1.65 | Crack | ◎ | ◎ | ◎ | ◎ | ◎ |
| | | | Wear resistance | ◎ | ◎ | ◎ | ◎ | ○ |

TABLE 3-continued

| Test No. | Bulk density of disk part ($g/cm^3$) | Test item | Heating temperature (°C.) 900 | 1000 | 1100 | 1200 | 1250 |
|---|---|---|---|---|---|---|---|
| 4 | 1.50 | Crack | ◎ | ◎ | ◎ | ◎ | ◎ |
| | | Wear resistance | ◎ | ◎ | ◎ | ◎ | ○ |
| 5 | 1.45 | Crack | ◎ | ◎ | ◎ | ◎ | ◎ |
| | | Wear resistance | ◎ | ◎ | ◎ | ○ | Δ |
| 6 | 1.60 | Crack | ◎ | ◎ | ◎ | ◎ | ◎ |
| | | Wear resistance | ◎ | ◎ | ◎ | ◎ | ○ |
| 7 | 1.65 | Crack | ◎ | ◎ | ○ | Δ | x |
| | | Wear resistance | ◎ | ◎ | — | — | — |
| 8 | 1.60 | Crack | ◎ | ◎ | ○ | Δ | x |
| | | Wear resistance | ◎ | ◎ | — | — | — |
| Comparative Ex. | 1.60 | Crack | x | * | * | * | * |
| | | Wear resistance | x | — | — | — | — |

Remarks:

| Symbol | Crack | Wear resistance |
|---|---|---|
| ◎ | none | excellent |
| ○ | small | good |
| Δ | medium | ordinary |
| x | large | bad |
| * | largest | |

What is claimed is:

1. A disk roll made of a thin sheet, said thin sheet being prepared from a mixture of flaky vermiculite particles having a diameter of 1 mm or less and a thickness of 100μ or less obtained by pulverizing expanded vermiculite with 40 to 230% weight, on the basis of the amount of vermiculite, of wallastonite fibers having a length of 3 mm or less in accordance with the sheet-forming process of a paper making technique.

2. A disk roll made of vermiculite, said disk roll produced by pulverizing expanded vermiculite particles into flakes having a particle size of 1 mm or less and a thickness less than 100μ, dispersing said vermiculite particles into water, filtering said particles to form a thin sheet and drying by a paper making technique, punching the sheets into rings, fitting a series of rings to a desired thickness successively onto an iron or steel axis and subjecting the rings to compression to form the disk roll.

3. A disk roll according to claim 2 wherein the compression is within the range of 50–250 $kg/cm^2$.

4. A disk roll according to claim 2 wherein the disk roll has a bulk density of from 1.2–1.8 $g/cm^3$.

5. A disk roll according to claim 2 wherein the vermiculite flakes are mixed with 40 to 230% by weight of wollastonite fibers, based on the weight of the vermiculite, said fibers having a length of 3 mm or less.

6. A disk roll according to claim 2 wherein the vermiculite flakes are mixed with ceramic fibers selected from the group consisting of crystalline alumina fibers or silica fibers in the range of 10–100%, based on the weight of the vermiculite.

* * * * *